United States Patent [19]

Nakayama

[11] Patent Number: 4,905,356

[45] Date of Patent: Mar. 6, 1990

[54] RESIDUAL LAP CLEARING APPARATUS

[75] Inventor: Hiroshi Nakayama, Kanazawa, Japan

[73] Assignee: Kabushiki Kaisha Murao and Company, Kanazawa, Japan

[21] Appl. No.: 343,585

[22] Filed: Apr. 27, 1989

[30] Foreign Application Priority Data

May 2, 1988 [JP] Japan ..... 63-109462

[51] Int. Cl.[4] ..... B65H 73/00

[52] U.S. Cl. ..... 28/292

[58] Field of Search ..... 28/292, 293, 294

[56] References Cited

U.S. PATENT DOCUMENTS

| | | | |
|---|---|---|---|
| 2,443,002 | 6/1948 | Giffin et al. | 28/293 |
| 2,739,326 | 3/1956 | Martin | 28/292 |
| 2,752,273 | 6/1956 | Mitchell | 28/294 |
| 4,793,036 | 12/1988 | Nakayama | 28/294 |

FOREIGN PATENT DOCUMENTS

| | | | |
|---|---|---|---|
| 54-22528 | 8/1979 | Japan . | |
| 151952 | 1/1962 | U.S.S.R. | 28/294 |

*Primary Examiner*—Werner H. Schroeder

*Attorney, Agent, or Firm*—Oblon, Spivak, McClelland, Maier & Neustadt

[57] ABSTRACT

A residual lap clearing apparatus for clearing a residual lap from a lap bobbin. The residual lap clearing apparatus comprises a rotary brush roller for stripping the residual lap off the lap bobbin, a support roller for supporting a lap package for residual lap clearing operation, a brake mechanism for braking the lap package during the residual lap clearing operation, and a comb roller for removing bunches of fibers caught in the bristles of the rotary brush roller off the rotary brush roller. The rotary brush roller surely finds the free end of the residual lap and clears the residual lap perfectly from the lap bobbin.

8 Claims, 4 Drawing Sheets

RESIDUAL LAP CLEARING APPARATUS

RELATED ART

The present invention relates to a residual lap clearing apparatus for efficiently clearing residual laps, such as residual ribbon laps or residual silver laps, from lap bobbins.

In a spinning mill, bales of raw textile fibers are opened, extraneous matters are removed from the fibers and the fibers are collected in a lap through an opening and picking process. Lap machines are used at the end of the opening and picking process. The lap machines from lap packages by winding a lap round lap bobbins having a large diameter, and then the lap packages are delivered to the next process.

In a carding process subsequent to the opening and picking process, silver lap machines or ribbon lap machines are used to form silver lap packages or ribbon lap packages for combers. Silver laps or ribbon laps are wound on lap bobbins in silver lap packages or ribbon lap packages for handling.

In those processes, lap packages formed by winding laps round lap bobbins are sent from the machines of the preceding process to those of the succeeding process and empty lap bobbins are returned from the latter to the former to use the lap bobbins repeatedly in those processes. Accordingly, the lap bobbins must perfectly be cleared of residual laps before the lap bobbins are used on lap machines and the like for winding laps.

Japanese Patent Publication No. 54-22528 discloses a residual lap clearing apparatus for clearing residual laps from lap bobbins, comprising, in combination, a drafting mechanism and air nozzles.

This known residual lap clearing apparatus holds a lap package having a residual lap wound round a lap bobbin on a pair of parallel rollers of the drafting mechanism and jets air jets from the air jets in a direction tangent to the lap package while the lap package is rotated by the drafting mechanism in a direction for unwinding the residual lap to find the free end of the lap and to unwind the lap.

Since this known residual lap clearing apparatus uses only air jets for finding the free end of the residual lap, the direction of the air jets must be aligned accurately with a tangent to the circumference of the lap package at the free end of the lap, more precisely, a tangent to the second top layer of lap of the lap package at the boundary of the free end of the lap and the second top layer of lap. However, the amount of residual laps on lap packages is not always constant, and hence it is impossible for air nozzles to meet such conditions. Thus, this known residual lap clearing apparatus is unable to find the free end of the residual lap without fail and often fails in clearing the residual lap from the lap bobbin.

DISCLOSURE OF THE INVENTION

Accordingly, it is an object of the present invention to provide a residual lap clearing apparatus capable of surely finding the free end of a residual lap on a lap package and surely clearing the residual lap from the lap bobbin at high efficiency.

According to the present invention, a lap package is fed accurately to the residual lap clearing apparatus, and the lap bobbin can easily be discharged from the residual lap clearing apparatus after clearing the residual lap from the lap bobbin.

BRIEF DESCRIPTION OF THE DRAWINGS

FIGS. 1 through 4 show a residual lap clearing apparatus in a preferred embodiment according to the present invention, in which:

FIG. 1 is a view of assistance in explaining the construction of a principal portion of the residual lap clearing apparatus, FIG. 2 is a side elevation of the residual lap clearing apparatus;

FIG. 3 is a sectional view taken on line III—III in FIG. 2; and

FIG. 4 is a sectional view taken on line IV—IV in FIG. 2. $B_0$ . . . Lap bobbin, $F_0$ . . . Frame, PH . . . Photoelectric sensor, $L_0$ . . . Lap.

DETAILED DESCRIPTION OF THE PREFERRED EMBODIMENT

A residual lap clearing apparatus embodying the present invention will be described hereinafter with reference to FIGS. 1 to 4.

Figure 1:
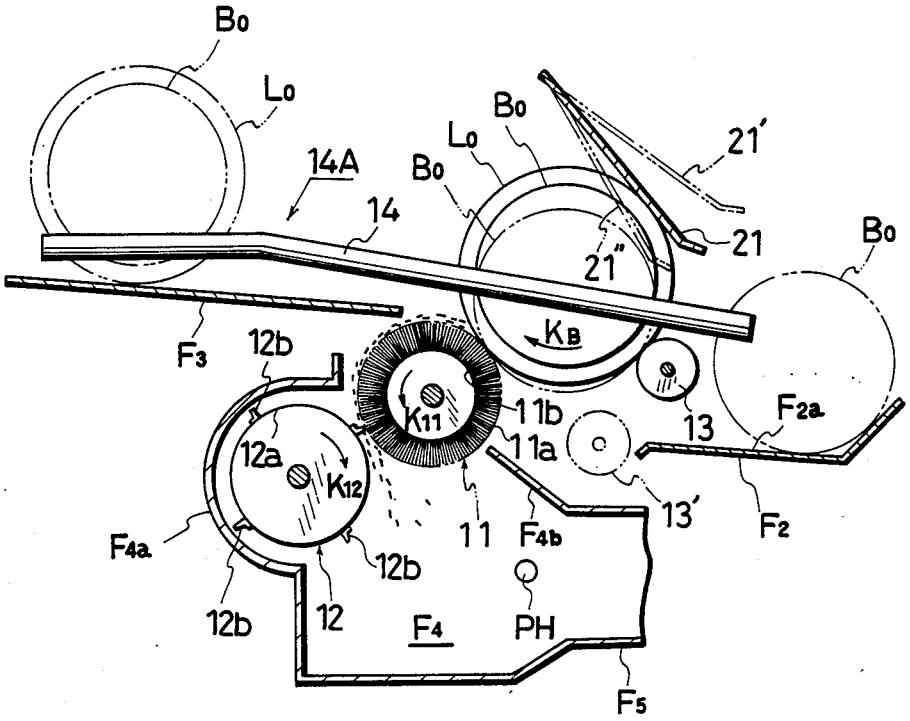

As shown in FIG. 1, the residual lap clearing apparatus comprises, as principal components, a rotary brush roller 11, a comb roller 12 and a support roller 13.

Figure 2:
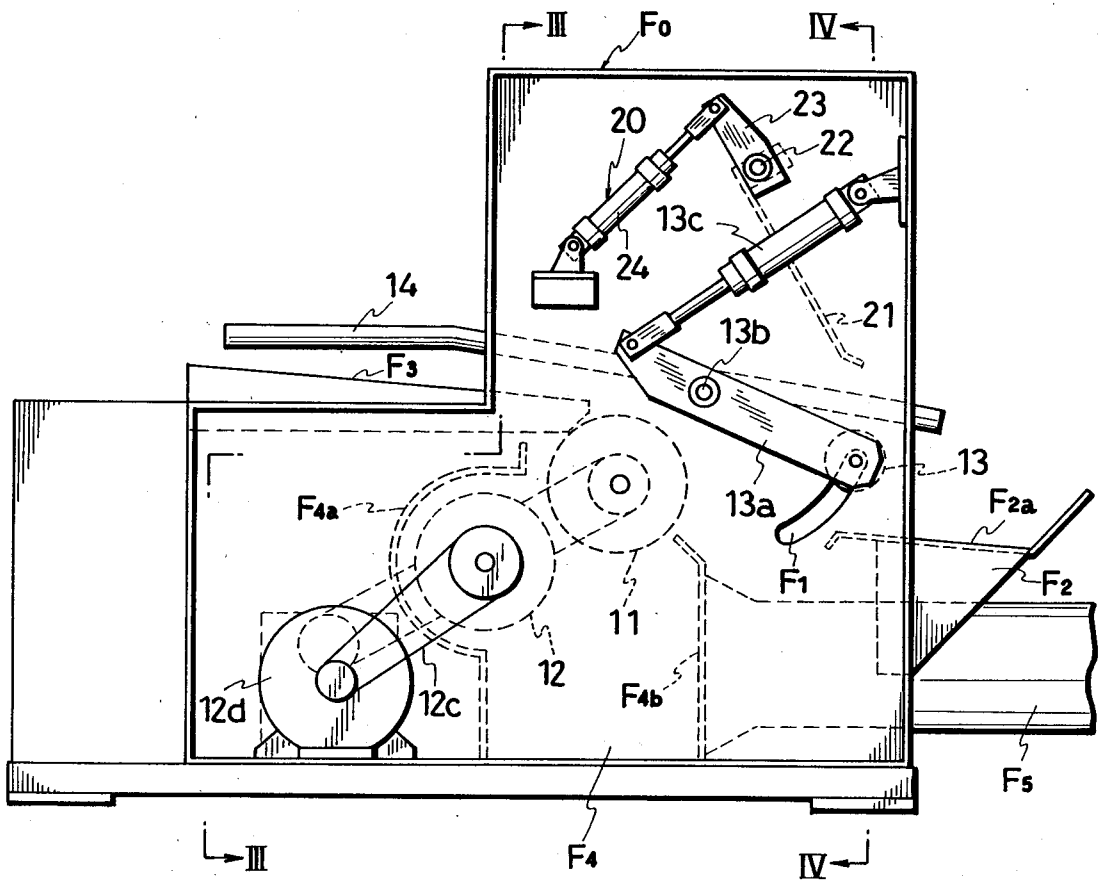
Figure 3:
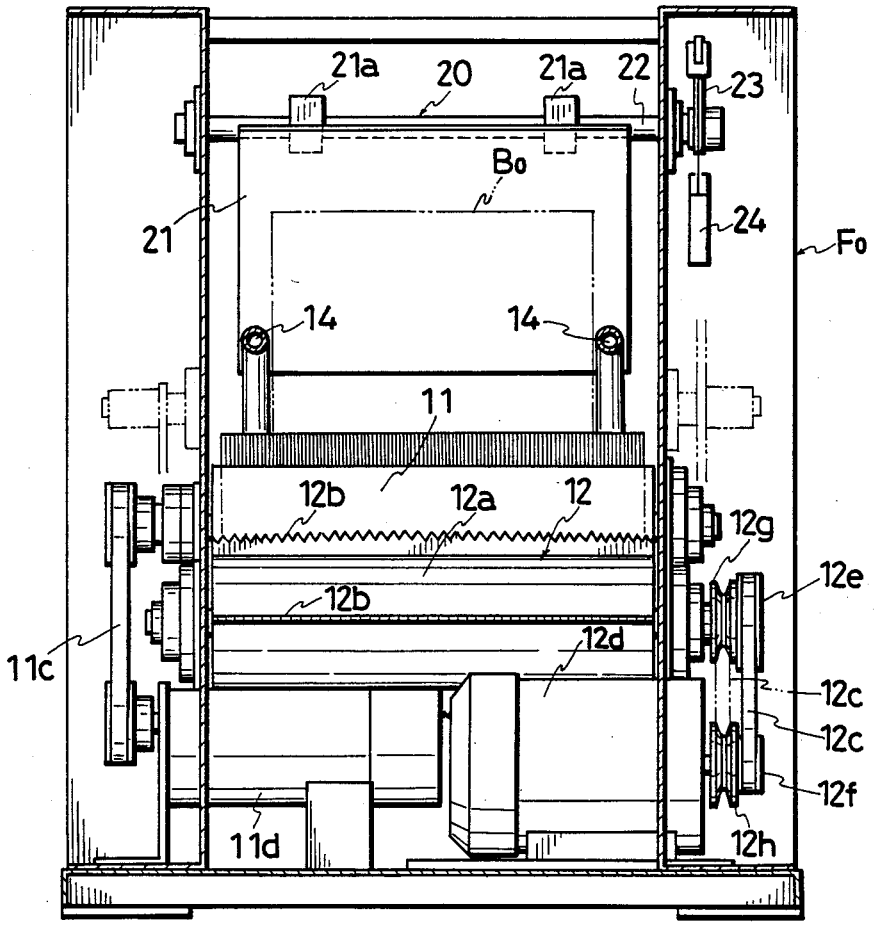

The rotary brush roller 11 comprises a brush cylinder 11a and hard bristles 11b attached to the circumference of the brush cylinder 11*a*. The rotary brush roller 11 is journaled in a horizontal position on a frame $F_0$ as shown in FIG. 3. As shown in FIGS. 2 and 3, the rotary brush roller 11 is driven for rotation at an optional rotating speed by a variable-speed motor 11*d* through a belt 11*c* extended around a driven belt pulley fixed to one end of the shaft of the rotary brush roller 11 and a driving pulley fixed to the output shaft of the variable-speed motor 11*d*.

The comb roller 12 comprises a rotary cylinder 12*a* and sawtooth combs 12*b* attached to the circumference of the rotary cylinder 12*a* so as to extend in parallel to the axis of the rotary cylinder 12*a*. The comb roller 12 is disposed relative to the rotary brush roller 11 so that the tips of the sawtooth combs 12*b* engage the extremities of the bristles 11*b* of the rotary brush roller 11. The comb roller 12 is driven through a belt 12*c* by a motor 12*d*. The belt 12*c* is extended selectively around a pair of belt pulleys 12*e* and 12*f* or a pair of belt pulleys 12*g* and 12*h*. The pairs of belt pulleys 12*e* and 12*f*, and 12*g* and 12*h* are different from each other in reduction ratio.

As shown in FIG. 2, the support roller 13 is supported rotatably on one end of each of a pair of swing levers 13*a* pivotally supported respectively by fixed pins 13*b* on the frame $F_0$. The swing levers 13*a* are turned on the fixed pins 13b to move the support roller 13 between an upper operating position and a lower standby position along guide slots $F_1$ formed in the frame $F_0$. When located at the upper operating position as indicated by a solid line in FIG. 1, the support roller 13 supports a lap package formed on a lap bobbin $B_0$ for rotation in cooperation with the rotary brush roller 11. When located at the lower standby position as indicated at 13' by an alternate long and two short dashes line in FIG. 1, the support roller 13 is retracted from the operating position to allow the lap bobbin $B_0$ to be delivered to a bobbin tray $F_2$ included in a bobbin discharge mechanism. As shown in FIG. 2, the bobbin tray $F_2$ is projected outside from the rear end of the frame $F_0$ and has a bent surface $F_{2a}$ for receiving the lap bobbin $B_0$ thereon. The other end of one of the pair of swing levers 13*a* is connected to the extremity of the operating rod of a cylinder actuator 13*c* pivotally supported at one end thereof on the frame $F_0$.

Figure 4:
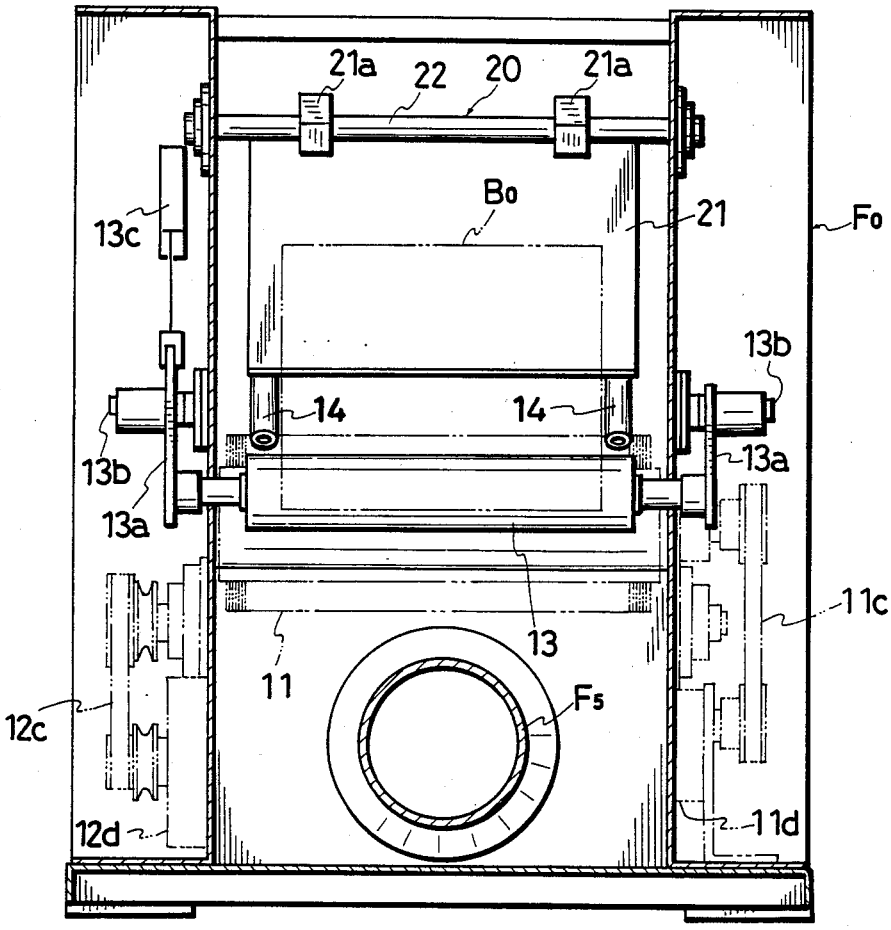

A brake mechanism 20 is disposed above the rotary brush roller 11 (FIGS. 2 to 4). The brake mechanism 20 comprises a braking plate 21, a shaft 22, a lever 23 and a cylinder actuator 24. The shaft 22 is journaled on the frame $F_0$ at the opposite ends thereof. The upper side of the braking plate 21 is fixed to brackets 21a, which in turn are fixed to the shaft 22. The lever 23 is fixed to one end of the shaft 22 projecting outside from the frame $F_0$, and the free end of the lever 23 is connected to the operating rod of a cylinder actuator 24 pivotally supported at one end thereof on the frame $F_0$. The operating rod of the cylinder actuator 24 is projected or retracted to move the braking plate 21 to a braking position where the lower surface of the braking plate 21 is pressed against the circumference of a lap package formed on the lap bobbin $B_0$ and supported on the rotary brush roller 11 and the support roller 13, or to retract the braking plate 21 from the braking position to a standby position where the braking plate 21 is separated from the lap bobbin $B_0$ to release the same.

A guide mechanism 14A is disposed on the front side, the left side as viewed in FIG. 1, of the frame $F_0$. The guide mechanism 14A comprises a feed chute $F_3$ declining toward the rotary brush roller 11, and a pair of guide rails 14 disposed above the feed chute $F_3$ so as to extend over the support roller 13 to a position above the bobbin tray $F_2$ to limit the axial position of the lap package formed on the lap bobbin $B_0$ properly (FIGS. 1, 3 and 4).

Referring to FIG. 1 again, a waste lap container having a waste collecting chamber $F_4$ is disposed under the rotary brush roller 11 and the comb roller 12. The waste lap container has a guide panel $F_{4a}$ surrounding a portion of the circumference of the comb roller 12, and a partition panel $F_{4b}$ extending diagonally upward near to the rotary brush roller 11. A photoelectric sensor PH for detecting the presence of waste lap in the waste collecting chamber $F_4$ is provided in the waste collecting chamber $F_4$. A suction duct $F_5$ connected to a waste collecting apparatus, not shown, is connected to the waste collecting chamber $F_4$.

The operation of the residual lap clearing apparatus thus constructed will be described hereinafter. The support roller 13 is positioned at the upper operating position by projecting the operating rod of the cylinder actuator 13*c* to turn the swing lever 13*a* in a counterclockwise direction as viewed in FIG. 2. Then, a lap package formed on a lap bobbin $B_0$ carrying a residual lap $L_0$ is supplied onto the feed chute $F_3$. Then, the lap package rolls down along the feed chute $F_3$ to be supported between the rotary brush roller 11 and the support roller 13 as indicated by a solid line in FIG. 1. While the lap package is rolling down along the feed chute $F_3$, the operating rod of the cylinder actuator 24 is retracted to keep the braking plate 21 of the brake mechanism 20 at the standby position so that the residual lap $L_0$ on the lap bobbin $B_0$ will not come into contact with the braking plate 21. The lap bobbin $B_0$ carrying the residual lap $L_0$ is placed on the feed chute $F_3$ in a position to make the lap package formed on the lap bobbin $B_0$ to be rotated in a direction to unwind the residual lap $L_0$ by the rotary brush roller 11. It is desirable to provide the guide mechanism 14A with a package detector, such as a limit switch, to operate the support roller 13 and the brake mechanism 20 properly upon the detection of the lap package on the guide mechanism 14A.

Then, the operating rod of the cylinder actuator 24 is projected to bring the braking plate 21 into contact with the residual lap $L_0$ as indicated by solid lines in FIG. 1, the variable-speed motor 1*d* is actuated to drive the rotary brush roller 11 for rotation in the direction of an arrow $K_{11}$ (FIG. 1) and, at the same time, the motor 12*d* is actuated to drive the comb roller 12 for rotation in the direction of an arrow $K_{12}$ (FIG. 1).

Then, the lap package formed on the lap bobbin $B_0$ is rotated in the direction of an arrow $K_B$ (FIG. 1) the same direction of rotation for unwinding the residual lap $L_0$ wound on the lap bobbin $B_0$. Consequently, the free end of the residual lap $L_0$ is caught readily by the bristles 11*b* of the rotary brush roller 11, and then layers of the residual lap $L_0$ is peeled continuously off the lap bobbin $B_0$. The braking plate 21 is kept in contact with the residual lap $L_0$ to press the lap package against the rotary brush roller 11 and to brake the lap package, so that the rotary brush roller 11 slips hardly relative to the lap package and the rotary brush roller 11 is able to find the free end of the residual lap $L_0$ and to clear the residual lap $L_0$ from the lap bobbin $B_0$ without fail.

The residual lap $L_0$ removed from the lap bobbin $B_0$ is caught and conveyed in bunches by the bristles 11*b* of the rotary brush roller 11, the bunches are combed off the bristles 11*b* by the combs 12*b* of the comb roller 12, and then the bunches combed off the bristles 11*b* fall into the waste collecting chamber $F_4$. The waste fibers thus collected in the waste collecting chamber $F_4$ are conveyed through the suction duct $F_5$ to and accumulated in the waste collecting apparatus, not shown.

While the residual lap $L_0$ is being cleared from the lap bobbin $B_0$, the bunches of fibers fly across the photoelectric sensor PH. Upon the completion of clearing the residual lap $L_0$ from the lap bobbin $B_0$, the photoelectric sensor PH provides a signal. Then, the rotary brush roller 11 and the comb roller 12 are stopped, the operating rod of the cylinder actuator 13*c* is retracted to shift the support roller 13 from the upper operating position to the lower standby position, i.e., the position indicated at 13' in FIG. 1, and the operating rod of the cylinder actuator 20 is retracted to shift the braking plate 21 from the braking position to the standby position to allow the empty lap bobbin $B_0$ to be discharged onto the bobbin tray $F_2$. In some cases, a very thin layer of fibers remains over the circumference of the lap bobbin $B_0$ in the final stage of the residual lap clearing operation, in which the photoelectric sensor PH does not detect any fiber. If such a lap bobbin $B_0$ still carrying residual fibers is used on a lap machine, an initial lap winding operation to start winding a new lap on the lap bobbin $B_0$ may not surely be achieved. Such an imperfect residual lap clearing operation often occurs particularly when the lap bobbin is provided with shallow annular grooves or fine longitudinal furrows in the circumference thereof. To avoid such an imperfect residual lap clearing operation, the rotating speed of the rotary brush roller 11 is increased after the end of detection of waste fibers by the photoelectric sensor PH to enhance the lap stripping action of the rotary brush roller 11 so that the thin layer of the residual lap $L_0$ can surely be cleared from the lap bobbin $B_0$. The duration of operation of the rotary brush roller 11 at an increased rotating speed is set beforehand by using a timer or the like.

A lap bobbin conveyor unit for conveying empty lap bobbins to a lap forming process or a lap bobbin storage unit for storing empty lap bobbins may be provided near the bobbin tray $F_2$.

Another cylinder actuator may be provided for pushing the empty lap bobbin $B_0$ obliquely upward to move the empty lap bobbin $B_0$ over the support roller 13 to the bobbin tray $F_2$ instead of shifting the support roller 13 to the lower standby position.

As is apparent from the foregoing description, the residual lap clearing apparatus of the present invention is able to support a lap package rotatably between the support roller and the rotary brush roller, and is able to discharge the empty lap bobbin readily from the residual lap clearing apparatus. Furthermore, since the residual lap remaining on the lap bobbin is subjected to the mechanical free end finding and residual lap stripping action of the rotary brush roller, the free end of the residual lap can be found successfully at a very high rate.

Still further, the rotation of the lap package in a direction to unwind the residual lap enhances the mechanical residual lap stripping action of the rotary brush roller, so that the residual lap clearing operation is achieved at a high efficiency.

What is claimed is:

1. A residual lap clearing apparatus for clearing a lap remaining on a lap bobbin, and thereby forming a lap package, comprising:

a rotary brush roller having bristles thereon and journaled on a frame;

a comb roller journaled on the frame with its axis in parallel to that of the rotary brush roller, provided with combs and disposed so that the combs engage the bristles of the rotary brush roller;

a support roller disposed with its axis in parallel to that of the rotary brush roller and capable of being moved between an operating position to support the lap package and a standby position to allow the lap bobbin of the lap package to move away from the rotary brush roller after all the lap remaining on the lap bobbin has been cleared from the lap bobbin;

a guide mechanism for guiding the lap package to a position between the rotary brush roller and the support roller; and a brake mechanism having swingable braking means for braking the lap package when the same is rotated by the rotary brush roller, and disposed above a position where the lap package is supported rotatably on the rotary brush roller and the support roller.

2. A residual lap clearing apparatus according to claim 1, wherein said guide mechanism comprises: a feed chute having one end at a lap package feed position and the other end at a position above the rotary brush roller, and declining toward the rotary brush roller; and a pair of guide rails extended above the feed chute to guide a lap package properly toward the rotary brush roller and to limit the axial movement of the lap package on the rotary brush roller.

3. A residual lap clearing apparatus according to claim 1, wherein said brake mechanism comprises: a shaft rotatably supported on the frame; a cylinder actuator having an operating rod pivotally supported on the frame; a swing lever having one end fixed to one end of the shaft and the other end pivotally connected to the extremity of the operating rod of the cylinder actuator; and a braking plate fixed to the swing lever;

4. A residual lap clearing apparatus according to claim 1, wherein said support roller is supported rotatably on one end of each of a pair of swing levers, and the other end of one of the pair of swing levers is connected pivotally to an extremity of an operating rod of a cylinder actuator.

5. A residual lap clearing apparatus according to claim 1, wherein said rotary brush roller is driven for rotation by a variable-speed motor, and said comb roller is driven for rotation by a motor through a speed change mechanism of a belt-and-pully system.

6. A residual lap clearing apparatus according to claim 1, wherein said rotary brush roller and said comb roller are disposed in an inlet of a waste lap collecting chamber connected through a suction duct to a waste lap collecting apparatus.

7. A residual lap clearing apparatus according to claim 6, wherein said waste lap collecting chamber is provided with a photoelectric sensor for detecting the presence of waste fibers within the waste lap collecting chamber.

8. A residual lap clearing apparatus according to claim 7, wherein said photoelectric sensor is connected electrically through a timer to driving means for driving said rotary brush roller and said comb roller.

* * * * *